US009309831B2

(12) United States Patent
Nowak et al.

(10) Patent No.: US 9,309,831 B2
(45) Date of Patent: Apr. 12, 2016

(54) PISTON ARRANGEMENT FOR A COMBUSTION CHAMBER OF AN INTERNAL COMBUSTION ENGINE, HAVING A VARIABLE COMPRESSION RATIO

(75) Inventors: Dieter Nowak, Weilheim (DE); Tilmann Roemheld, Waiblingen (DE); Michael Wagenplast, Schwaigern (DE)

(73) Assignee: Daimler AG, Stuttgart (DE)

( * ) Notice: Subject to any disclaimer, the term of this patent is extended or adjusted under 35 U.S.C. 154(b) by 0 days.

(21) Appl. No.: 14/350,246

(22) PCT Filed: Sep. 4, 2012

(86) PCT No.: PCT/EP2012/003700

§ 371 (c)(1),
(2), (4) Date: Jul. 9, 2014

(87) PCT Pub. No.: WO2013/050100

PCT Pub. Date: Apr. 11, 2013

(65) Prior Publication Data

US 2014/0311439 A1 Oct. 23, 2014

(30) Foreign Application Priority Data

Oct. 8, 2011 (DE) ..... 10 2011 115 417

(51) Int. Cl.
*F02D 15/02* (2006.01)
*F02F 3/00* (2006.01)
*F02B 75/04* (2006.01)

(52) U.S. Cl.
CPC ..... *F02F 3/0069* (2013.01); *F02B 75/044* (2013.01); *F02B 75/045* (2013.01); *F02D 15/02* (2013.01)

(58) Field of Classification Search
CPC ..... F02B 75/044; F02B 75/045; F02D 15/02; F02F 3/0069
USPC ..... 123/48 B, 78 B, 78 BA
See application file for complete search history.

(56) References Cited

U.S. PATENT DOCUMENTS 4,687,348 A * 8/1987 Naruoka et al. ..... 384/255
4,784,093 A 11/1988 Pfeffer et al.

(Continued)

FOREIGN PATENT DOCUMENTS

DE 33 46 967 A1 7/1985
DE 36 38 783 C2 5/1988

(Continued)

OTHER PUBLICATIONS

Corresponding International Search Report with English Translation dated Jan. 31, 2013 (six (6) pages).

(Continued)

*Primary Examiner* — Marguerite McMahon
(74) *Attorney, Agent, or Firm* — Crowell & Moring LLP

(57) ABSTRACT

A piston arrangement for a combustion chamber of an internal combustion engine having a variable compression ratio. A piston includes a device for the variable adjustment of the compression ratio associated with the combustion chamber, and a piston pin is coupled to the piston via respective connecting regions, via which piston pin the piston can be coupled to a connecting rod of the internal combustion engine. The device includes the piston pin having at least one eccentric element, which is eccentrically arranged with respect to the connecting regions of the piston pin and via which the piston pin can be coupled to the connecting rod.

7 Claims, 7 Drawing Sheets

(56) References Cited

U.S. PATENT DOCUMENTS

Figure 1:
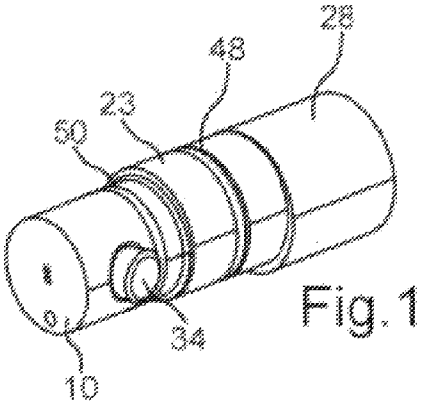

| | | | | |
|---|---|---|---|---|
| 4,864,975 | A * | 9/1989 | Hasegawa | 123/48 B |
| 4,864,977 | A * | 9/1989 | Hasegawa | 123/48 B |
| 5,417,185 | A | 5/1995 | Beattie | |
| 2009/0107467 | A1* | 4/2009 | Berger | 123/48 B |
| 2011/0079200 | A1* | 4/2011 | Lee | 123/48 B |

FOREIGN PATENT DOCUMENTS

| | | | |
|---|---|---|---|
| DE | 197 57 871 | A1 | 7/1999 |
| DE | 10 2009 048 172 | A1 | 4/2011 |
| JP | 58-38344 | A | 3/1983 |
| JP | 60-142020 | A | 7/1985 |
| JP | 63-86351 | U | 6/1988 |
| JP | 1-110845 | A | 4/1989 |
| WO | WO 2010/124971 | A1 | 11/2010 |

OTHER PUBLICATIONS

German language Written Opinion dated Jan. 31, 2013 (six (6) pages).

Japanese Office Action issued in counterpart Japanese Application No. 2014-533777 dated Jun. 30, 2015, with partial English translation (Four (4) pages).

* cited by examiner

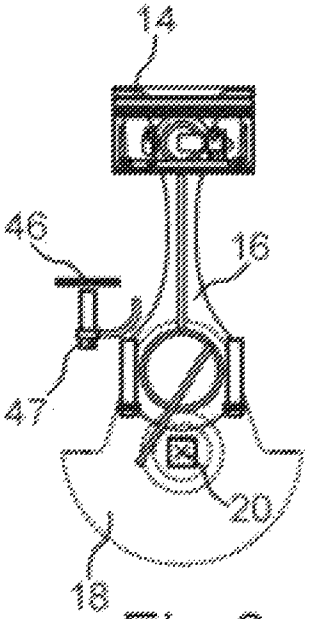
Fig.8a
Fig.8b
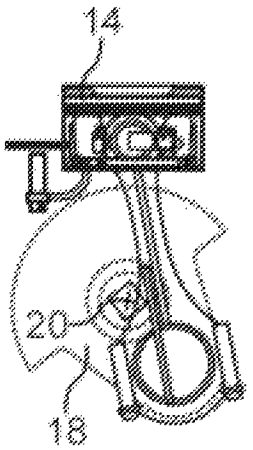
Fig.8c
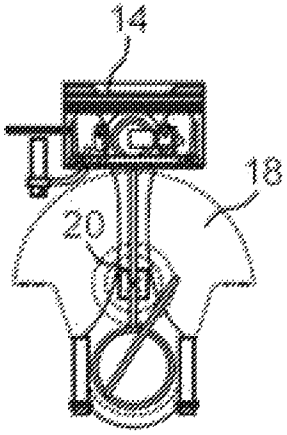
Fig.8d
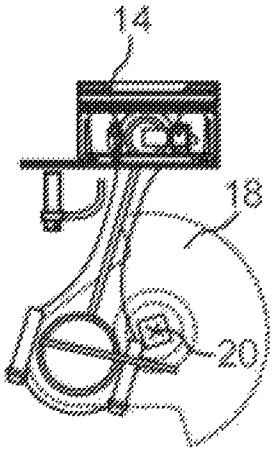
Fig.8e

PISTON ARRANGEMENT FOR A COMBUSTION CHAMBER OF AN INTERNAL COMBUSTION ENGINE, HAVING A VARIABLE COMPRESSION RATIO

BACKGROUND AND SUMMARY OF THE INVENTION

Exemplary embodiments of the invention relate to a piston arrangement for a combustion chamber of an internal combustion engine having a variable compression ratio.

German patent document DE 33 46 967 C2 discloses a plunger piston having variable compression height for internal combustion engines, in which the piston crown is arranged in a relatively axially displaceable manner with at least one part of the piston ring section on the lower part which accommodates the piston pin. In the plunger piston, two interconnected chambers are provided which can be filled with pressure oil, and the respective volumes of which change with respect to one another in reciprocal proportion upon relative displacement of the piston crown, and of which a first chamber as control chamber lies directly below the piston crown, while a second chamber as damping chamber is arranged below the control chamber. Furthermore, in the piston, the pressure oil is conducted via valves, of which one is designed as a pressure limiting valve and is arranged between the control chamber and a space that is open towards the crankcase. The damping chamber is arranged in a divided manner in the interior of the piston and is delimited by a shoulder emanating from the center of the piston crown, a central recess in the piston lower part is provided for engaging with the shoulder engages, a collar of the piston lower part projects radially into the recess at the piston-crown-side end of the recess and which separates the two chambers from one another, and a sealing washer can be detachably fastened to the shoulder and which is held by a screw screwed to the shoulder.

A device for controlling the oil feed into a control chamber of the piston having variable compression height for internal combustion engines is disclosed in German patent document DE 36 38 783 C2. The control chamber is arranged between an inner piston part and an outer piston part that is displaceably guided thereon. The control chamber is connected to the lubricating oil circuit of the internal combustion engine via an oil hole, which is arranged in the inner piston part and in the course of which a non-return valve that opens in the direction towards the control chamber is fitted. The oil hole opens into an oil groove in a small-end bushing of the connecting rod articulated to the inner piston part via a hollow piston pin which forms an oil storage chamber, and via a longitudinal oil hole having a control oil groove and extending from the oil groove through the shaft of the connecting rod supported by a connecting rod bearing, and a transverse hole extending in the crank pin between the control oil groove and a main oil hole.

Here, the connecting rod bearing contains the control oil groove across part of the circumference thereof arranged in such a way that the transverse hole overlaps the control oil groove in the region between the last third of the piston outward movement to the last third of the piston inward movement.

Moreover, a piston for an internal combustion engine having a variable compression ratio is known from German patent document DE 10 2009 048 172 A1. The piston comprises a first piston part and a second piston part coupled movably relative to one another, forming at least one first chamber, to which a pressure medium, in particular a pressure fluid, can be supplied, and the volume of which is variable.

Here, at least one control valve device is arranged internally on a piston skirt of the piston, by means of which a volume of the pressure medium in the first chamber can be adjusted.

For a reciprocating piston engine, in particular an internal combustion engine, having a device for changing the piston stroke function, it is proposed in German patent document DE 197 57 871 A1 to attach to the cylinder block, in the vicinity of the piston or of the connecting rod, an electrical coil, which is not moved by the crank drive and between which and an oscillating component moved by the crank drive a force action can be produced at least cyclically corresponding to the movement of the crank drive. The force action can be produced directly via an electromagnetic field or indirectly by mechanical contact, wherein, due to the force action of the coil, a connecting link is displaced into the interior or in the interior of the cylinder barrel such that same cyclically comes into contact with the component moved by the crank drive. The device for changing the piston stroke function can be controlled or the adjustment state thereof detected due to the force action.

Japanese patent document JP 60 142020 A likewise discloses an internal combustion engine having a piston, a piston pin and a connecting rod in a cylinder, wherein the piston pin is designed at least partially eccentrically in the length thereof and can be moved by means of a control element into at least two positions and, thereby, the compression ratio of the cylinder of the internal combustion engine can be changed.

It has been shown that adjustments of the piston height of this kind and therefore of the compression ratio are intricate.

Exemplary embodiments of the present invention are directed to a piston arrangement for a combustion chamber having a variable compression ratio, by means of which a simple variable adjustment of the compression ratio of the combustion chamber is made possible.

Such a piston arrangement for a combustion chamber having a variable compression ratio, in particular cylinder, of an internal combustion engine which is designed, in particular, as a reciprocating piston internal combustion engine, in particular of a motor vehicle, includes a piston and a device for the variable adjustment of the compression ratio associated with the combustion chamber. Furthermore, the piston arrangement includes a piston pin. The piston pin is coupled to the piston via respective connecting regions. Here, the piston pin is accommodated, for example, at least in some areas, in accommodating openings, in particular passages, of the piston. The piston can be coupled to a connecting rod of the internal combustion engine, in particular in an articulated manner, via the piston pin.

The piston can be coupled in an articulated manner to a crankshaft of the internal combustion engine via the piston pin and the connecting rod such that translational movements of the piston in the combustion chamber relative thereto can be converted into a rotational movement of the crankshaft.

According to the invention, the device includes the piston pin. Here, the piston pin has at least one eccentric element, which is eccentrically arranged with respect to the connecting region of the piston pin and via which the piston can be coupled to the connecting rod. If the piston pin is coupled to the connecting rod via the eccentric element and if the piston pin is rotated relative to the connecting rod about the longitudinal central axis of the eccentric element, which is designed at least substantially in the form of a right circular cylinder, and relative to the piston about the longitudinal central axis of the at least one connecting region of the piston pin, which is designed at least substantially in the form of a right circular cylinder, then, as a result of the eccentric arrangement of the eccentric element relative to the connecting region of the piston pin, the rotation of the piston pin relative to the connecting rod and relative to the piston causes the piston arranged in the combustion chamber to be moved, in particular displaced, relative to the connecting rod in the direction of the longitudinal extension thereof.

This is accompanied by a change in the distance between the piston and the axis of rotation of the crankshaft. Furthermore, this is accompanied by a change in the distance between the piston and a combustion chamber roof of the combustion chamber. Thereby, the compression ratio of the combustion chamber is changed. The change in the compression ratio is implemented here in a particularly simple and therefore cost-effective and installation-space-effective manner.

Moreover, by means of the piston arrangement according to the invention, it is possible to adjust the compression ratio as required and to suit different operating points of the internal combustion engine. The internal combustion engine can therefore be operated efficiently and with only a small energy consumption, in particular fuel consumption. Further, the piston arrangement is not only highly compact but also has a very high proportion of identical parts compared with a conventional piston arrangement that does not allow the compression ratio to be adjusted. This results in low costs.

In an advantageous embodiment of the invention, the device includes at least one control element. Here, the control element can be moved on the piston relative to the piston and relative to the piston pin between at least two positions. In particular, the control element can be displaced at an angle or perpendicular to the longitudinal extension of the piston pin, on account of which the control element is also referred to as a control slider. A rotation of the piston pin relative to the piston can be effected or prevented by means of the control element.

In other words, when the control element is in the first position, depending on the rotational position of the piston pin, the control element effects a locking of the piston pin or a rotation of the piston pin relative to the piston. The compression ratio can thus optionally be maintained or changed.

In the piston arrangement according to the invention, the rotation of the piston pin relative to the piston and therefore the setting or adjustment of the compression ratio is preferably carried out as a result of centrifugal or inertial forces of the piston moving in the combustion chamber and/or as a result of pressure forces prevailing in the combustion chamber and acting on the piston. This provides a simple adjustment of the compression ratio without additional active actuating elements, which keeps the installation space required for the piston arrangement and the costs thereof low.

Further advantages, features and details of the invention are clear from the following description of a preferred embodiment and on the basis of the drawing. The features and combinations of features stated above in the description and the features and combinations of features stated below in the description of the drawings and/or shown in the drawings alone can be used not only in the combination specified in each case, but also in other combinations or in isolation without departing from the scope of the invention.

BRIEF DESCRIPTION OF THE DRAWING FIGURES

Figure 2:
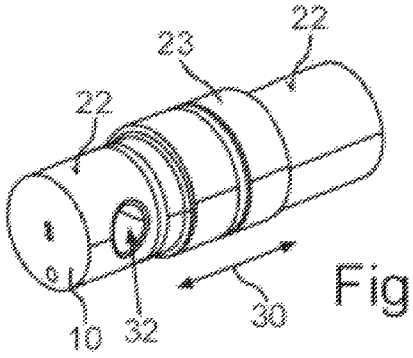
Figure 3:
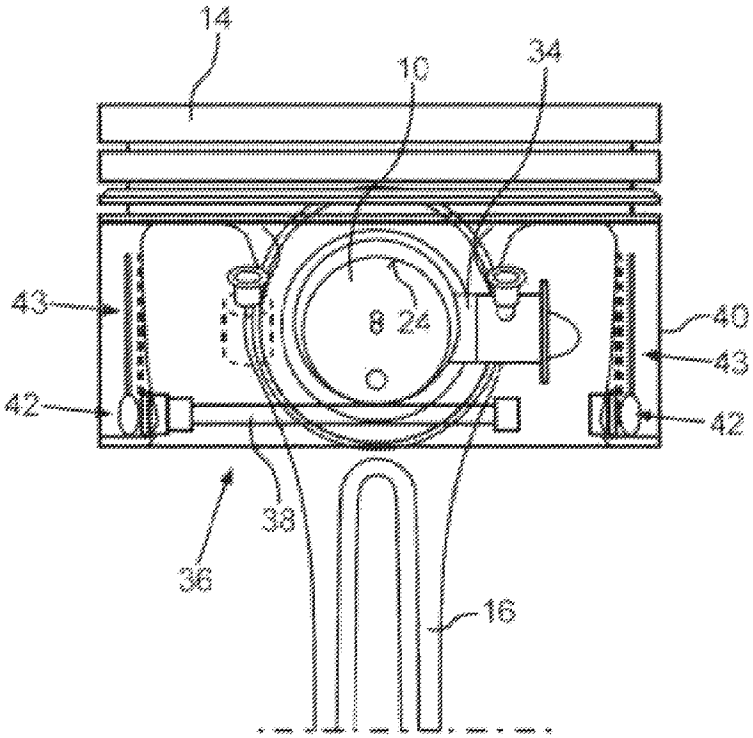
Figure 6:
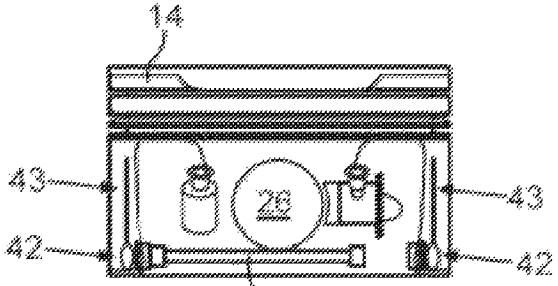
Figure 4:
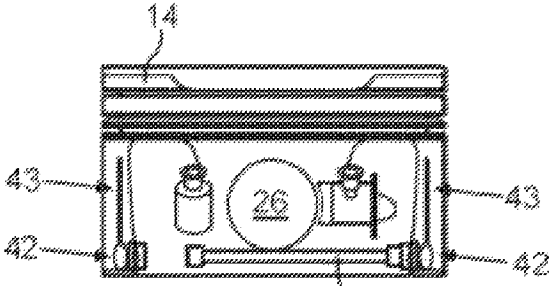
Figure 7:
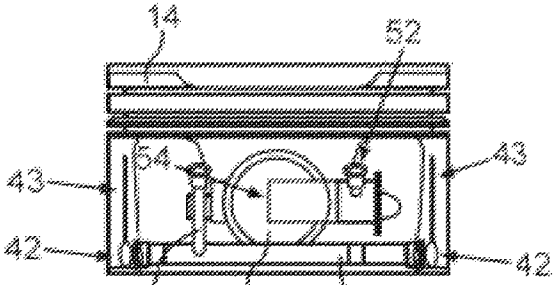
Figure 5:
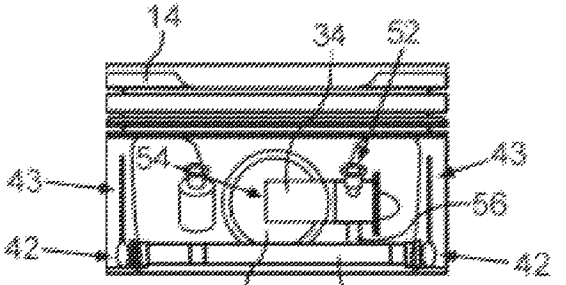
Figure 9:
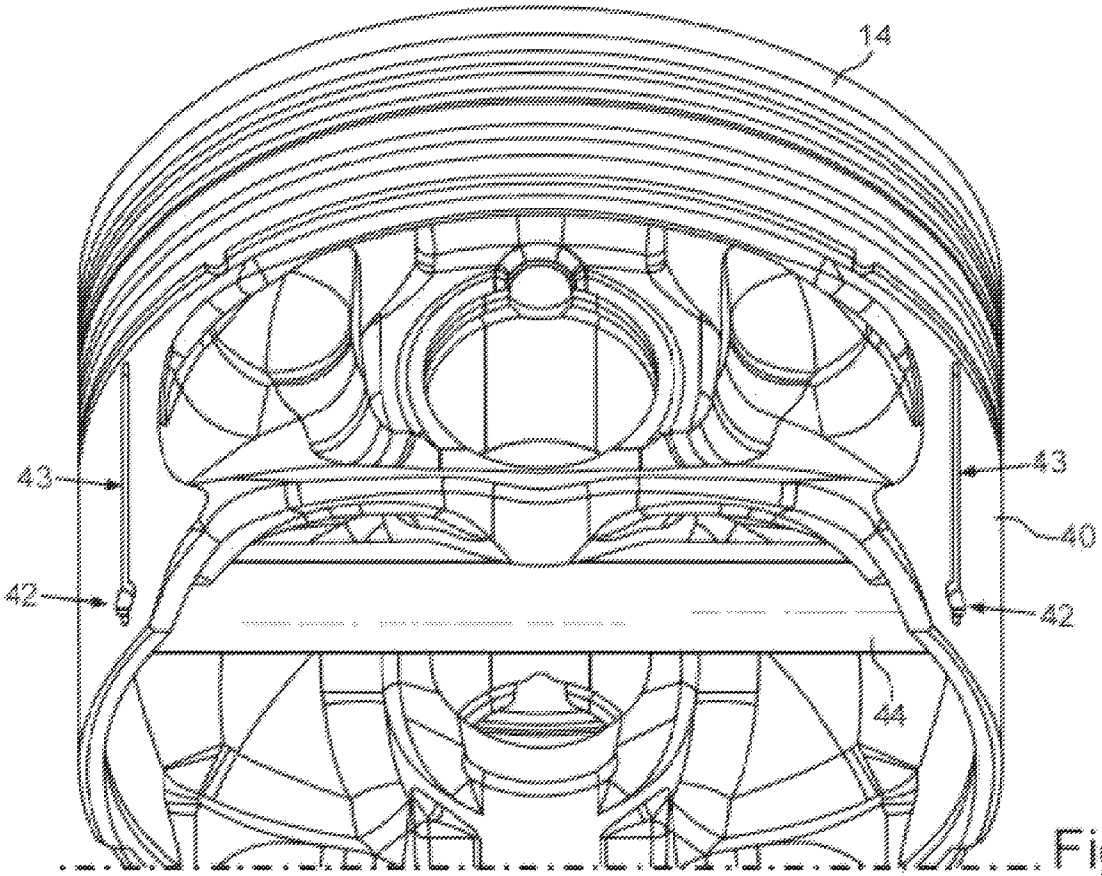
Figure 10:
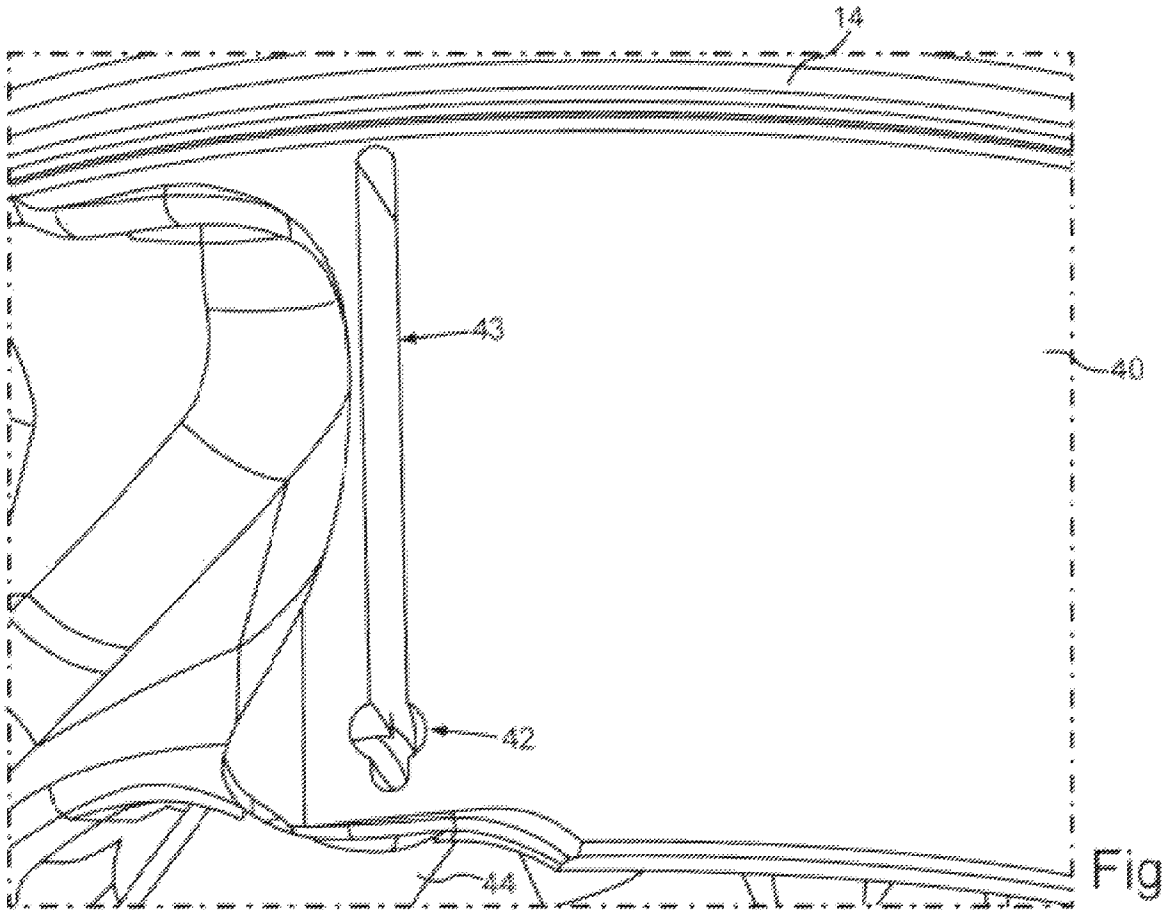
Figure 11:
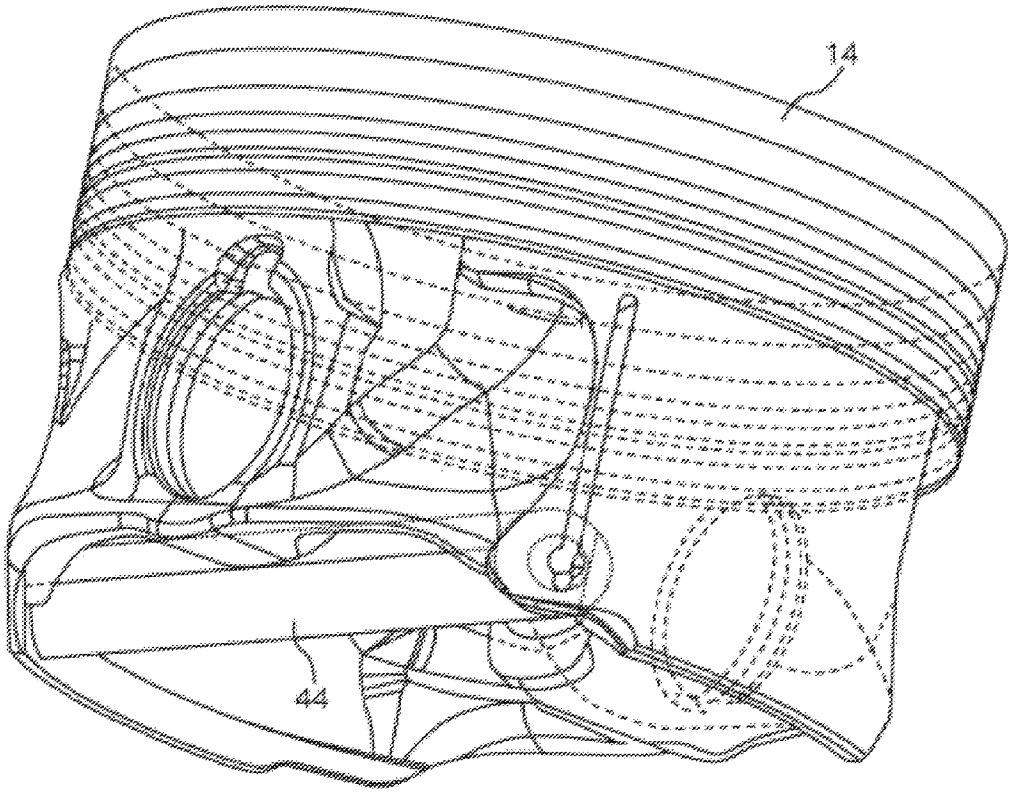
Figure 12:
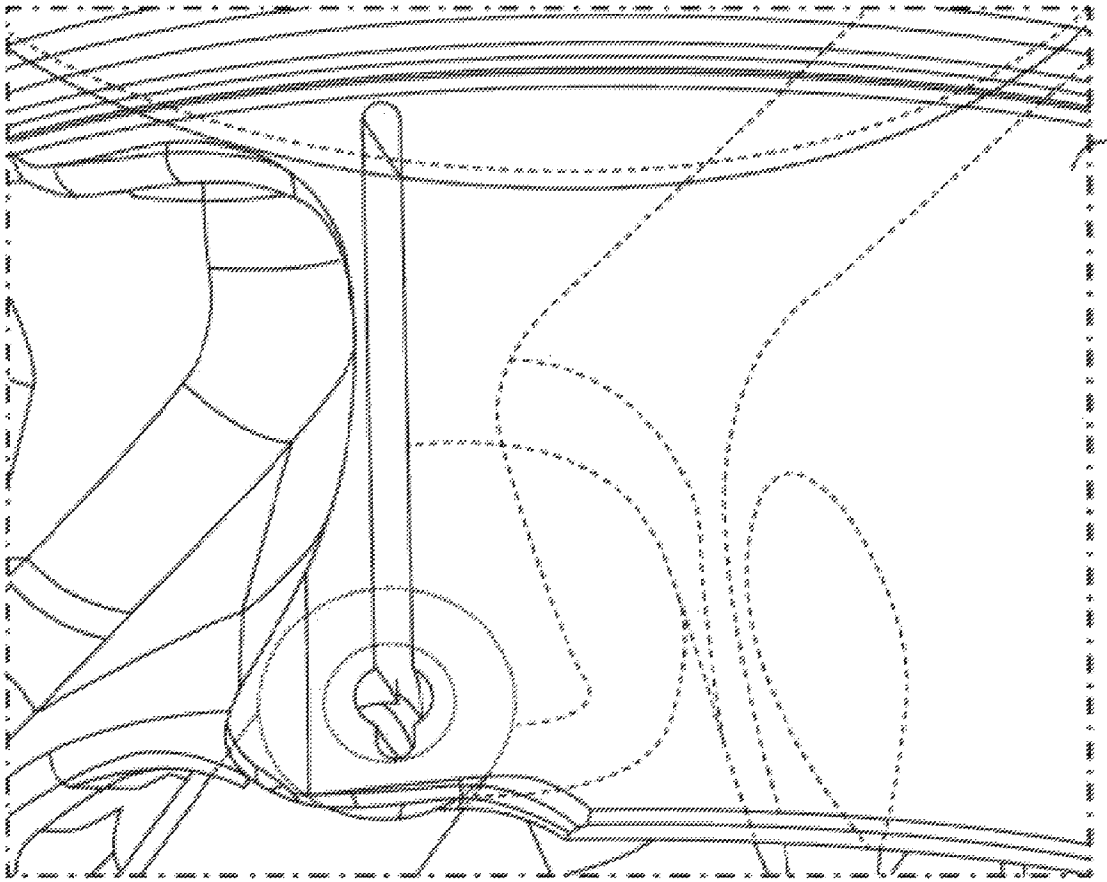

The drawing shows, in:

FIG. 1 a schematic perspective view of a piston pin having a blocking element and a piston pin bushing of a piston arrangement shown in FIG. 3;

FIG. 2 a schematic perspective view of the piston pin according to FIG. 1;

FIG. 3 in section, a schematic lateral view of a piston arrangement for a cylinder of a reciprocating piston internal combustion engine having a variable compression ratio, comprising a transparently represented piston which is coupled in an articulated manner via the piston pin according to FIGS. 1 and 2 to a connecting rod of the piston arrangement, wherein the piston arrangement includes a device by means of which the compression ratio can be adjusted;

FIG. 4 a schematic lateral view of the piston according to FIG. 3, wherein a control element of the device is in the first position thereof;

FIG. 5 a further schematic lateral view of the piston according to FIG. 4;

FIG. 6 a further schematic lateral view of the piston according to FIGS. 4 and 5, wherein the control element is in the second position thereof;

FIG. 7 a further schematic lateral view of the piston according to FIG. 6;

FIG. 8*a-e* in each case, a schematic lateral view of the piston arrangement according to FIG. 3 during a stroke movement in the cylinder, wherein the compression ratio is adjusted;

FIG. 9 in section, a schematic perspective view of the piston according to FIG. 3;

FIG. 10 in section, a further schematic perspective view of the piston according to FIG. 9;

FIG. 11 a schematic perspective view of the piston according to FIGS. 9 and 10, wherein the piston is transparently represented; and FIG. 12 in section, a schematic perspective view of the piston according to FIG. 11, wherein the piston is transparently represented.

DETAILED DESCRIPTION

FIGS. 1 and 2 show a piston pin 10 of a piston arrangement 12 (FIG. 3), via which a piston 14 of the piston arrangement is to be coupled in an articulated manner to a connecting rod 16 of an internal combustion engine designed as a reciprocating piston internal combustion engine. As can be seen in conjunction with FIG. 8*a-e*, the internal combustion engine includes a crankshaft 18 mounted in a crankcase such that same can be rotated relative to the crankcase about an axis of rotation 20. The crankshaft 18 includes a crank pin, on which the connecting rod 16 is mounted in an articulated manner via a large connecting rod end. The connecting rod 16 further includes a connecting-rod small end in which the piston pin 10 is accommodated in some areas.

The piston pin 10 is coupled to the piston 14 via respective connecting regions 22. The connecting regions 22 of the piston pin 10 are formed by an outer peripheral lateral surface of the piston pin 10, wherein the connecting regions are designed at least substantially in the form of a right circular cylinder. To couple the piston pin 10 to the piston 14, the connecting regions 22 are accommodated at least in some areas in respective accommodating openings 26 of the piston 14, here formed as passages.

The piston pin 10 is indirectly connected to the piston 14 via the right-hand - referred to the drawing plane of FIG. 2—connecting region 22 of the piston pin 10. As can be seen from FIG. 1, the piston arrangement 12 includes a piston pin bushing 28, in which the right-hand connecting region 22 of the piston pin 10 is arranged. The piston pin bushing 28 is accommodated in the corresponding accommodating opening 26. Here, the piston pin bushing 28 acts as a stop for the piston pin 10 and enables the piston pin 10 to be easily mounted to or in the piston 14.

The piston pin 10 has an eccentric element 23, which is at least substantially designed in the form of a right circular cylinder and is arranged eccentrically with respect to the connecting regions 22. This means that the longitudinal central axis of the eccentric element is offset perpendicular to the respective longitudinal central axes of the connecting regions 22, which are arranged coaxially with respect to one another. The piston pin 10 is articulated to the connecting rod 16 via the eccentric element 23, which is accommodated, at least in some areas, in the connecting-rod small end of the connecting rod 16. The piston 14 is therefore coupled in an articulated manner to the connecting rod 16. As a result of the articulated coupling, translational relative movements of the piston 14, which is accommodated in a cylinder of the internal combustion engine, relative to the cylinder can be converted into a rotational movement of the crankshaft 18 about the axis of rotation.

As is clear in particular from FIG. 2, the piston pin 10, which has a longitudinal extension indicated by a directional arrow 30, has an accommodating opening 32 which, for example, is designed as a passage. Here, the accommodating opening 32 extends at least substantially perpendicular to the longitudinal extension (directional arrow 30) of the piston pin 10.

A blocking element in the form of a locking bolt 34 is accommodated in the accommodating opening 32. Guided in the accommodating opening 32, the locking bolt 34 can be displaced relative to the piston pin 10 perpendicular to the longitudinal extension of the piston pin 10. In conjunction with FIG. 3, it can be seen that at least the piston pin 10 and the locking bolt 34 are assigned to a device 36 of the piston arrangement 12. The device 36 allows variable adjustment of the compression ratio of the cylinder of the internal combustion engine associated with the piston arrangement 12.

For this purpose, the device 36 also includes a control element in the form of a control slider 38. The control slider 38 is held on the piston 14 and can be displaced relative to the piston 14 and relative to the piston pin 10 between two positions. Here, the control slider 38 can be displaced exclusively between the two positions. The control slider 38 therefore is a so-called bistable control piston.

In a first position of the control slider 38 shown in particular in FIGS. 4 and 5, same is held by means of a first magnet. Here, the first magnet is arranged on the piston 14. In the second position shown in particular in FIGS. 3, 6 and 7, the control slider 38 is held by means of a second magnet, wherein the second magnet is also held on the piston 14. A sleeve 44 of the device 36, in which the control slider 38 is displaceably accommodated, can be seen in particular in FIG. 9.

By displacing the control slider 38 at least substantially perpendicular to the longitudinal extension of the piston pin 10 between the two positions thereof, a movement of the locking bolt 34 between a release position and a blocking position of the locking bolt 34 can be effected or prevented and locked. In turn, the control slider 38 can be displaced between the two positions thereof by means of an actuator, for example, a solenoid, or by means of oil pressure. Here, the control slider 38 is displaced by means of oil pressure.

As can be seen from FIGS. 9 to 12, the piston 14 has two mutually opposing passages 42 in the piston skirt 40 thereof. The passages 42 completely pass through the piston skirt 40 and therefore an outer peripheral lateral surface of the piston 14. Connected to the passages are grooves 43, which run in the axial direction of the piston 14 and are connected to the passages 42. In other words, the grooves 43 open into the passages.

The adjustment of the compression ratio can be seen in particular from FIG. 8*a-e*. Via a supply element 46, for example, an oil injection nozzle, lubricating oil of the internal combustion engine is injected into the grooves 43 and into the passages 42 while the piston 14 moves in the cylinder. Thereby, the control slider 38 is supplied with, in particular pressurized with, lubricating oil from one of the end faces thereof. Here, the actuation by means of the lubricating oil takes place over 150° crank angle of the crankshaft 18, wherein the supply, i.e. the actuation of the control slider 38, starts at a rotational position of the crankshaft 18 according to FIG. 8*b* and ends at a further rotational position of the crankshaft 18 according to FIG. 8*e*. The other corresponding end face of the control slider 38 opposite the respective end face supplied with lubricating oil is not supplied with lubricating oil, which is ensured, for example, by cross-interlocked control valves. By supplying the one end face of the control slider 38, the control slider 38 is displaced in the direction of the other end face that is not supplied with lubricating oil. An oil injection nozzle 47, by means of which the piston 14 can be injected with lubricating oil and therefore cooled, can also be seen in FIG. 8*a-e*.

Here, the supply element 46 is arranged in the cylinder bore of the cylinder. In other words, the supply or actuation of the control slider 38 takes place from outside the piston 14 via the cylinder bore and therefore from outside the piston 14.

Here, the grooves 43, which can also be designed as elongated holes, serve to accommodate the lubricating oil via rotation of the crankshaft 18 and therefore via translational movement of the piston 14 in the cylinder, and guide the lubricating oil to the passages 42 and thereby to the control slider 38.

Here, the control slider 38 is used for the so-called pilot control of internal combustion engine lubricating oil, by means of which the locking bolt 34 is moved between at least one release position and at least one blocking position of the locking bolt 34.

The lubricating oil for adjusting the locking bolt 34 is transferred via bearing points of the crankshaft 18 in the crankcase to the crankshaft 18 and further via corresponding channels to the connecting rod 16. From the connecting rod 16, the lubricating oil flows to a first groove 48 of the piston pin 10 which runs completely around the outer periphery in the circumferential direction. From the first groove 48, the lubricating oil flows via at least one corresponding connecting channel to a second groove 50 of the piston pin 10 which likewise runs completely around the outer periphery in the circumferential direction of the piston pin 10. From the second groove 50, the lubricating oil can flow to corresponding channels 56, 58 in the piston 14. Depending on the position of the control slider 38, the lubricating oil can flow through the first channel 56 or the second channel 58, reach the locking bolt 34 and move same. Here, the channels 56, 58 are integrated directly into the piston 14, that is to say formed or delimited by walls of the piston 14. Here, the connecting channel of the piston pin 10 for fluidic connection of the grooves 48, 50 opens to the outside, therefore enabling excess lubricating oil to be used for cooling the piston 14.

FIG. 5 shows the control slider 38 in the first position thereof. The locking bolt 34 is initially in the blocking position thereof in which the locking bolt interacts with the piston 14 on the side of the right-hand groove 43—referred to the drawing plane FIG. 5—and prevents the piston pin 10 from rotating relative to the piston 14. That is to say, the piston pin 10 can only be rotated relative to the connecting rod 16 in the connecting-rod small end of the connecting rod 16 about the longitudinal central axis of the eccentric element 23 such that the piston 14 is coupled in an articulated manner to the connecting rod 16 via the piston pin 10. For this purpose, the locking bolt 34 is accommodated in some areas in the accommodating opening 32 and in some areas in a first receptacle in the piston 14 arranged on the side of the right-hand groove 43.

In the first position of the control slider 38, the first channel 56 in the piston 14 can be supplied with lubricating oil. A supply of lubricating oil to the second channel 58 in the piston 14 is prevented by the control slider 38. As can be seen from FIG. 5, in the first position of the control slider 38, the lubricating oil flows from the connecting rod 16 via the grooves 48, 50 into the right-hand first channel 56 and from there further to a first end face 52 of the locking bolt 34 which, in said position of the piston pin 10, is on the right-hand side. This means that the first end face 52 is supplied with the lubricating oil. The lubricating oil now pushes the locking bolt 34 in the radial direction of the piston pin 10 into the accommodating opening 32 and thus from the blocking position thereof into the release position thereof.

A spring element, via which the locking bolt 34 is supported on the piston pin 10 while acted upon by a spring force, can be arranged in the accommodating opening 32. Here, the spring force is directed outwards in the radial direction of the piston pin 10. That means that the lubricating oil then pushes the locking bolt 34 against the spring force into the accommodating opening 32 and out of the first receptacle. When the locking bolt 34 moves completely out of the first receptacle, same is in the release position thereof. In the release position, the locking bolt 34 can no longer prevent a relative rotation of the piston pin 10 with respect to the piston 14. The piston pin 10 can then be rotated relative to the connecting rod 16 in the connecting-rod small end of the connecting rod 16 about the longitudinal central axis of the eccentric element 23, and relative to the piston 14 in the accommodating openings 26 about the respective longitudinal central axes of the connecting regions 22.

Such a relative rotation is effected, for example, by inertial and/or centrifugal forces and/or by pressure forces prevailing in the cylinder and acting on the piston 14 as a result of the eccentric arrangement of the eccentric element 23 relative to the connecting regions 22. In the compression stroke of the piston 14, the piston 14 is pushed in the direction of the axis of rotation 20. As a result of the eccentric arrangement of the eccentric element 23 relative to the connecting regions 22, the distance between the piston 14 and the axis of rotation is reduced, and the distance between the piston 14 and a combustion chamber roof of the cylinder is increased, as a result of which the compression ratio ($\epsilon$) is reduced. During the intake stroke, the distance between the piston 14 and the axis of rotation 20 is increased in that the piston 14 is pulled away from the axis of rotation. As a result, a comparatively higher compression ratio is set. Here, the pushing and pulling of the piston 14, via the coupling thereof to the piston pin 10, causes the piston pin 10 to rotate relative to the piston 14 or relative to the connecting rod 16 when the locking bolt 34 is in the release position thereof.

Here, the piston pin 10 rotates through 180 degrees to the left—referred to the drawing plane of FIG. 5—thus, anticlockwise. When the accommodating opening 32 is designed as a passage, the lubricating oil acts via the first right-hand channel 56 on a second end face 54 of the locking bolt 34 which faces away from the first end face 52 and, together with the spring force of the spring element, pushes the locking bolt 34 outwards in the radial direction out of the accommodating opening 32. The locking bolt 34 is therefore moved from the release position thereof back into the blocking position thereof. The locking bolt 34 then acts together with the piston 14 on the side of the left-hand groove 43—referred to the drawing plane of FIG. 5—such that a rotation of the piston pin 10 relative to the piston 14 is again prevented. The piston pin 10 is locked.

For this purpose, the locking bolt 34 is accommodated, for example, in some areas, in the accommodating opening 32 and in some areas in a second receptacle in the piston 14 arranged on the side of the left-hand groove 43. The lubricating oil is used not only to move the locking bolt 34 but also to lock same in the blocking position and therefore also fulfils a locking function.

If—assuming—the control slider 38 is then moved (displaced) into the second position thereof, the supply of lubricating oil to the right-hand first channel 56 is terminated. The left-hand second channel 58 is then supplied with lubricating oil. The lubricating oil can then flow from the connecting rod 16 via the grooves 48, 50 into the left-hand second channel 58 and from there further to the first end face 52 which, in the present position of the piston pin, is on the left-hand side. This means that lubricating oil is now supplied to the first end face 52 again (no longer the second end face 54). The lubricating oil pushes the locking bolt 34 back into the release position thereof.

The piston pin can now rotate through 180 degrees again, only this time to the right, thus, clockwise. In turn, this is not effected by an active actuating element but substantially passively by the centrifugal and/or inertial and/or pressure forces.

As can be seen from FIG. 7, after rotating to the right, lubricating oil again is supplied to the second end face 54, only this time via the second channel 58. Thereby, together with the spring force, the locking bolt 34 is pushed into the blocking position thereof on the side of the right-hand groove 43 and locked by means of the lubricating oil. The piston pin 10 is locked again.

This means that, depending on the position of the control slider 38 and the rotational position of the piston pin 10 in the accommodating openings 26, lubricating oil can either be supplied to the first end face 52 or the second end face 54 and the locking bolt 34 can be moved (adjusted) accordingly, or the locking bolt 34 is locked, as a result of which the piston pin 10 is locked in the dead-centers of the piston 14.

It can be seen that, by means of the one control slider 38, two positions of the piston pin 10 and therefore two differing compression ratios of the cylinder can be presented by means of the piston arrangement 12. At least one further control slider like the control slider 38 can be provided, thus enabling two further positions of the piston pin 10 and therefore two further compression ratios to be presented by means of the further control slider. To present the two further compression ratios, the piston pin 10 is coupled to the piston, for example, via the two connecting regions 22 thereof, under interposition of appropriate eccentric bushings. This means that the piston 14 is mounted on the piston pin 10 via the eccentric bushings. In a similar way to the rotation of the piston pin 10 relative to the piston 14 by displacing the control slider 38, relative rotations of the eccentric bushings with respect to the piston 14 can then be effected by means of the further control slider such that, as a result, the piston 14 is adjusted relative to the axis of rotation 20 and relative to the combustion chamber roof.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A piston arrangement for a combustion chamber of an internal combustion engine having a variable compression ratio, comprising:

a piston;

a device configured for the variable adjustment of the compression ratio associated with the combustion chamber, the device comprising a piston pin coupled to the piston by respective connecting regions, wherein the piston pin is configured is to couple the piston to a connecting rod of the internal combustion engine, wherein the piston pin has at least one eccentric element eccentrically arranged with respect to the connecting region of the piston pin and is configured to couple the piston pin to the connecting rod, at least one control element, which is held on the piston in such a manner that it is movable relative to the piston pin and the piston between at least two positions, wherein the at least one control element is displaceable at an angle or perpendicular to a longitudinal extension of the piston pin, wherein displacement of the at least one control element controls whether the piston pin rotates relative to the piston, and a blocking element accommodated in the piston pin, wherein the blocking element is perpendicularly displaceable relative to the longitudinal extension of the piston pin between at least one release position and at least one blocking position, wherein in the release position of the blocking element the piston pin is rotatable relative to the piston and in the blocking position, in which the blocking element interacts with the piston, the piston pin is not rotatable relative to the piston, wherein the blocking element is moveable by the control element between the release position corresponding to the first position of the control element and the blocking position corresponding to the second position of the control element, wherein a lubricant of the internal combustion engine is suppliable to the blocking element via the control element to move the blocking element, and wherein the supply of the medium to the blocking element is controlled by the control element.

2. The piston arrangement according to claim 1, wherein the lubricant is supplied to the blocking element via at least one first channel provided on the piston, wherein the at least one first channel is in fluid connection with at least one second channel provided on the piston pin to conduct the lubricant.

3. The piston arrangement according to claim 2, wherein the first channel is integrated directly into the piston.

4. The piston arrangement according to claim 2, wherein the control element is configured so that supply of the lubricant to the first channel is allowed in one of the positions of the control element and prevented in the other position.

5. The piston arrangement according to claim 3, wherein the control element is configured so that supply of the lubricant to the first channel is allowed in one of the positions of the control element and prevented in the other position.

6. An internal combustion engine, comprising:

a piston arrangement for a combustion chamber of the internal combustion engine having a variable compression ratio, the piston arrangement comprising a piston;

a device configured for the variable adjustment of the compression ratio associated with the combustion chamber, the device comprising a piston pin coupled to the piston by respective connecting regions, wherein the piston pin is configured is to couple the piston to a connecting rod of the internal combustion engine, wherein the piston pin has at least one eccentric element eccentrically arranged with respect to the connecting region of the piston pin and is configured to couple the piston pin to the connecting rod, at least one control element, which is held on the piston in such a manner that it is movable relative to the piston pin and the piston between at least two positions, wherein the at least one control element is displaceable at an angle or perpendicular to a longitudinal extension of the piston pin, wherein displacement of the at least one control element controls whether the piston pin rotates relative to the piston, and a blocking element accommodated in the piston pin, wherein the block element is perpendicularly displaceable relative to the longitudinal extension of the piston pin between at least one release position and at least one blocking position, wherein in the release position of the blocking element the piston pin is rotatable relative to the piston and in the blocking position, in which the blocking element interacts with the piston, the piston pin is not rotatable relative to the piston, wherein the blocking element is moveable by the control element between the release position corresponding to the first position of the control element and the blocking position corresponding to the second position of the control element, wherein a lubricant of the internal combustion engine is suppliable to the blocking element via the control element to move the blocking element, and wherein the supply of the medium to the blocking element is controlled by the control element.

7. The internal combustion engine according to claim 6, wherein the piston has at least one passage penetrating an outer peripheral lateral surface of the piston and via which the lubricating oil of the internal combustion engine is suppliable to the control element from outside the piston in order to move the control element between the release and blocking positions.

* * * * *